US005983917A

United States Patent [19]

Thomas

[11] Patent Number: 5,983,917

[45] Date of Patent: Nov. 16, 1999

[54] FAUCET INSTALLATION AID

[75] Inventor: Kurt J. Thomas, Indianapolis, Ind.

[73] Assignee: Masco Corporation of Indiana, Indianapolis, Ind.

[21] Appl. No.: 09/240,525

[22] Filed: Jan. 29, 1999

Related U.S. Application Data

[63] Continuation of application No. 08/640,266, Apr. 30, 1996, Pat. No. 5,865,211.

[51] Int. Cl.[6] ..... F16K 27/06

[52] U.S. Cl. ..... 137/15; 137/316; 137/359; 4/675

[58] Field of Search ..... 137/359, 315, 137/316, 801, 15 I; 4/675, 676

[56] References Cited

U.S. PATENT DOCUMENTS

| | | | |
|---|---|---|---|
| 3,651,734 | 3/1972 | McSherry | 85/80 |
| 4,186,761 | 2/1980 | Guarnieri | 137/359 X |
| 4,704,057 | 11/1987 | McSherry | 411/55 |
| 5,232,008 | 8/1993 | Jeffress et al. | 137/801 X |
| 5,465,749 | 11/1995 | Saunter et al. | 137/359 |

*Primary Examiner*—Stephen M. Hepperle
*Assistant Examiner*—John Bastianelli
*Attorney, Agent, or Firm*—Leon E. Redman; Lloyd D. Doigan

[57] ABSTRACT

An installation aid for facilitating the installation of a faucet body of a two handle faucet to a sink deck. The aid has a frusto-conical configuration with a skirt formed of resilient circumferentially spaced apart legs extending radially outwardly downwardly from a top under a retention cap with fingers that removably attach the installation aid to an enlarged head of a spout tube extending upwardly from a central part of a faucet body having spaced valve tubes which along with the spout tube having the temporarily attached installation aid are inserted upwardly through sink deck holes from below the sink deck. The legs of the installation aid squeeze together as it is forced through the sink deck hole and spring back to a frusto-conical configuration for temporarily mounting the faucet body to the sink deck while an installer assembles attachment hardware to the valve tubes from above the sink deck without the need for the installer to hold the faucet body with one hand below the sink deck while installing attachment hardware with his other hand above the sink deck.

5 Claims, 6 Drawing Sheets

FAUCET INSTALLATION AID

This application is a continuation of Ser. No. 08/640,266 filed Apr. 30, 1996 now U.S. Pat. No. 5,865,211.

FIELD OF THE INVENTION

The present invention relates to faucets and in particular to a device for aiding in the installation of faucets.

BACKGROUND OF THE INVENTION

In installing certain faucets the faucet body is inserted through preformed holes in the sink deck from beneath the sink deck. After the body is inserted through the holes it must be supported by the installer with one hand to keep it from falling back through the holes while the base ring and attaching hardware are attached above the sink deck with the other hand. It is quite a stretch and quite difficult for the installer to hold the faucet body below the sink deck while at the same time reaching above the sink with the other hand to instal the attaching hardware. This is particularly true of faucet bodies known as widespread faucet bodies in which there are a pair of spaced apart control valves, one for hot water and one for cold water, spaced on either side of a centrally located spout.

It would be very advantageous if a means could be provided which temporarily supports the faucet body in place once the body is inserted up through the holes in the sink deck and allows the installer to fasten the faucet body to the sink deck obviating the installer using one hand below the deck to support the faucet body while the other hand fastens attachment hardware to the faucet body from above the deck. The instant invention provides such a device.

SUMMARY OF THE INVENTION

The present invention relates to a faucet installation aid.

The primary object of the invention is to temporarily support a faucet body inserted from below a sink deck in place to facilitate attachment of fasteners to the portion of the faucet body projecting above the sink deck.

Another object of the invention is to provide an improved method for simply and reliably mounting a widespread faucet to the sink deck.

Another object of the invention is to enable a widespread faucet to be installed without the need for the installer to hold the faucet body with one hand from one side of the sink deck while attaching it from the other side of the deck with the other hand.

These and other objects are achieved by the invention as will be apparent from the following specification, drawings and claims.

DESCRIPTION OF THE PREFERRED EMBODIMENT

Figure 1:
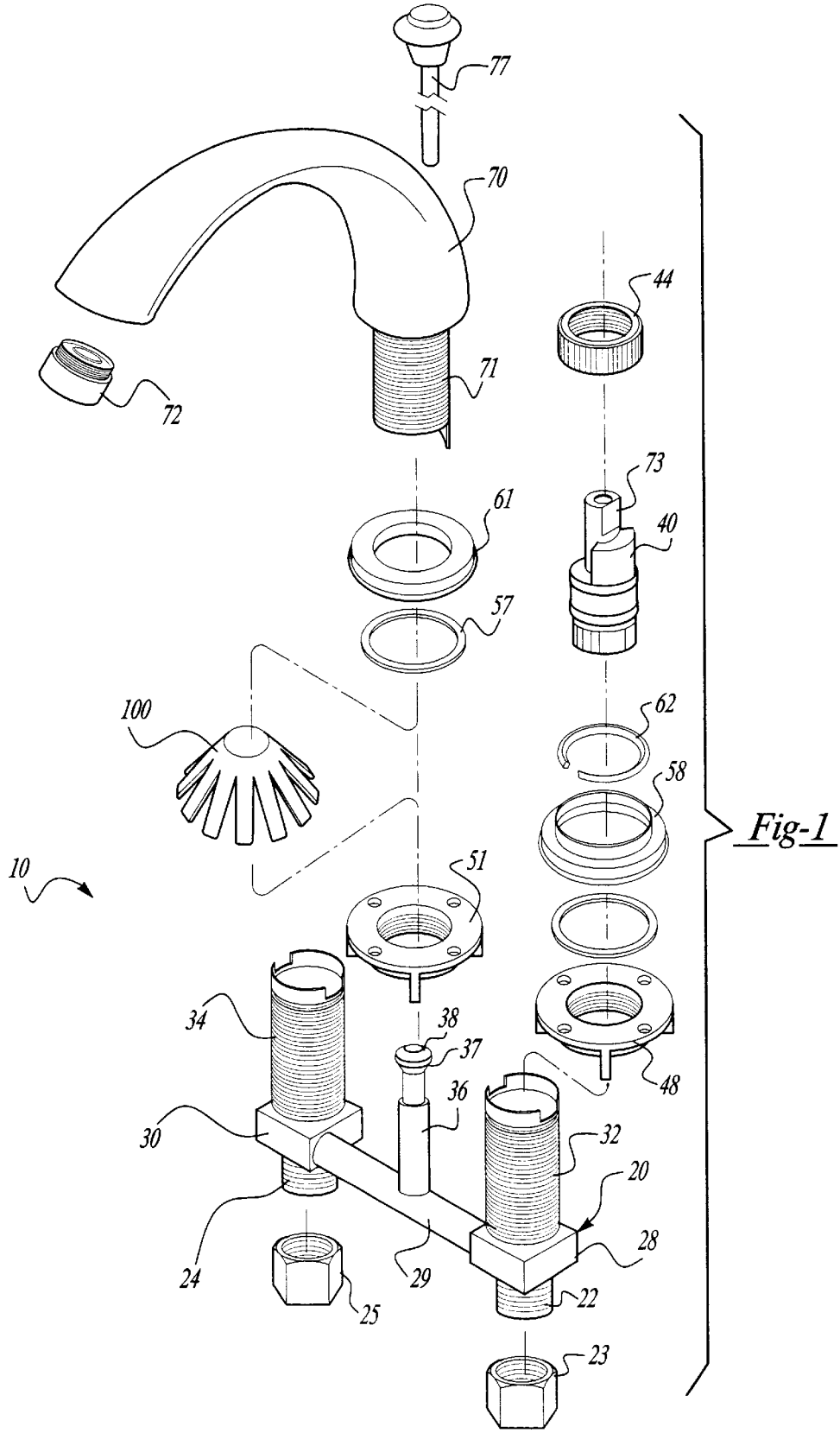
FIG. 1 is an exploded perspective of a faucet assembly using the faucet installation aid of the present invention.
Figure 2:
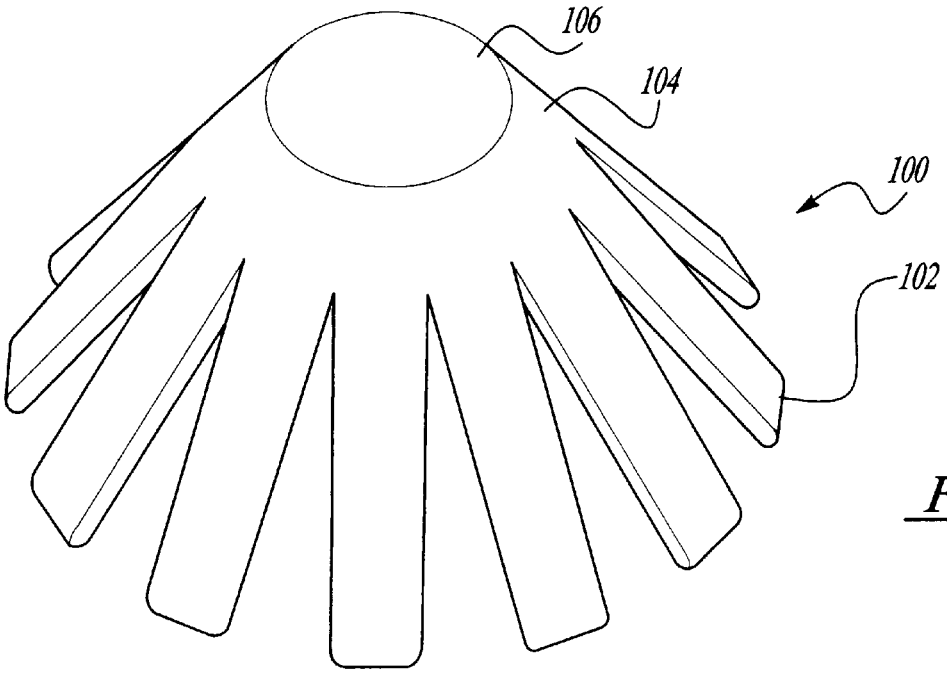
FIG. 2 is an enlarged perspective of the installation aid of FIG. 1.
Figure 3:
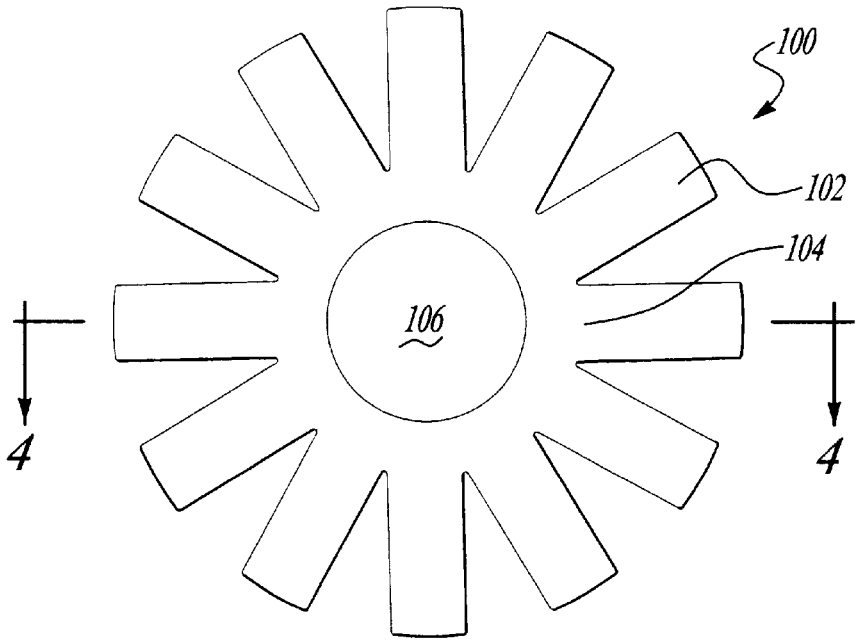
FIG. 3 is a top plan view of the faucet installation aid of FIG. 2.
Figure 4:
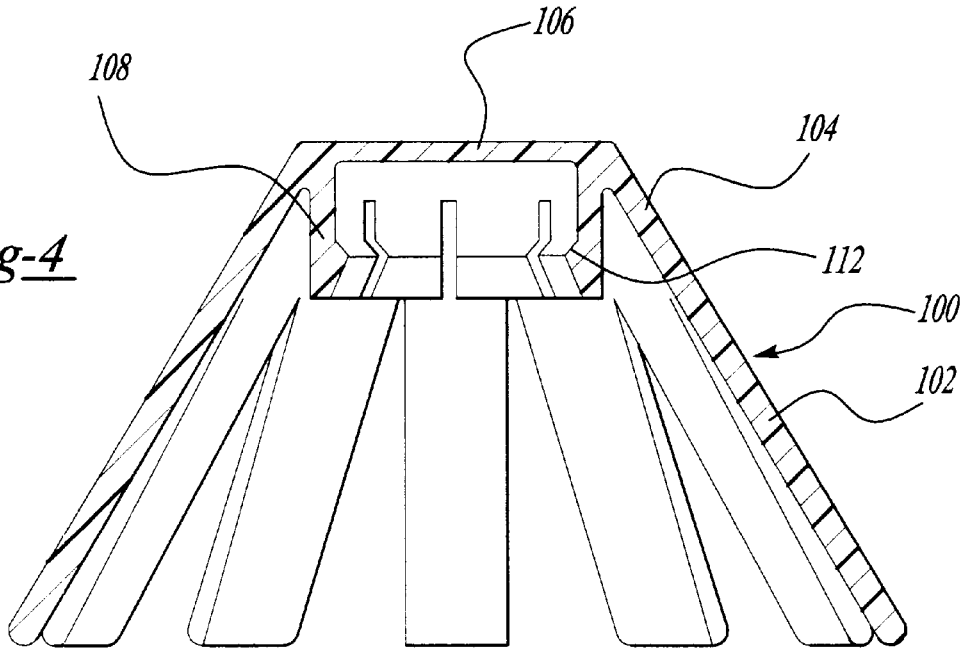
FIG. 4 is a cross-sectional view of the installation aid taken along lines 4—4 of FIG. 3.
Figure 5:
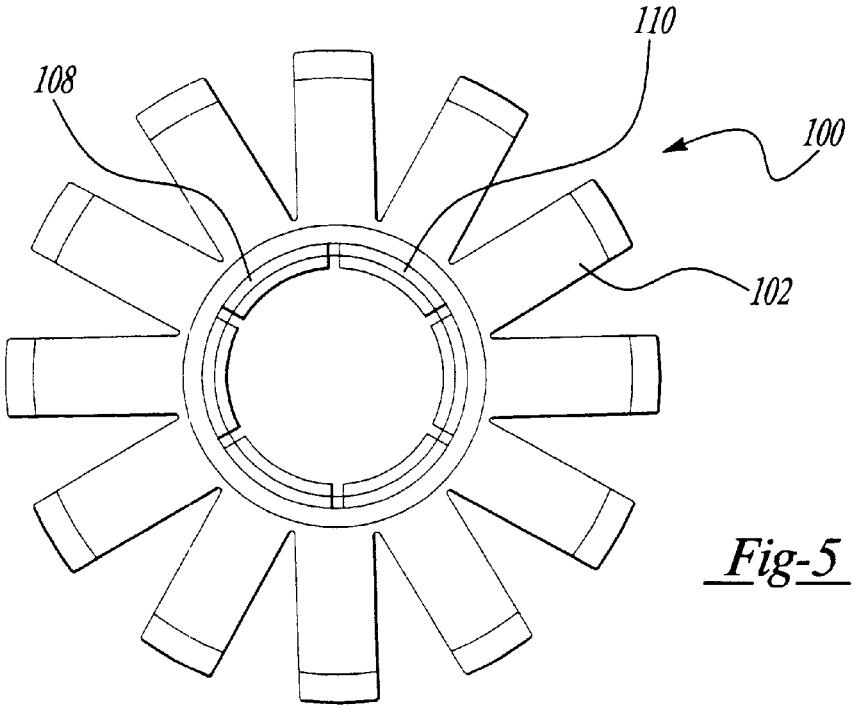
FIG. 5 is a bottom plan view of the installation aid of FIG. 2.

Referring to FIGS. 1 and 6*a*–6*d*, a widespread faucet assembly 10 includes a faucet body 20 having spaced apart valve plugs 22, 24 threaded for connection to cold and hot water supplies via supply nuts 23, 25. A casting 28, 30 provides a water passage from the valve plugs 22, 24 to upwardly extending threaded valve tubes 32, 34 with a horizontally extending waterway 29 therebetween. A spout tube 36 extends vertically from the waterway 26 intermediate the valve tubes 32, 34. An enlarged head 38 is formed at the top of the spout tube 36 and is provided with an O-ring 37 in a groove circumferentially formed in head 38. A valve 40, 42 is received in each of the valve tubes 32, 34 and secured therein by a bonnet nut 44, 46 threadably secured at the top of valve tubes 32, 34. When connected to hot and cold water supplies operation of the valves 40, 42 controls the flow of water into waterway 29 and up through spout tube 36.

Lock nuts 48, 50 are threadably disposed about valve tubes 32, 34. Lock nut 51 is loosely disposed about spout tube 36.

Prior to installation of the faucet body 20 to a sink deck 52 the installation aid or device 100 (see FIGS. 1–6*d*) is removably secured at the top of spout tube 36 to temporarily attach the faucet body 20 to the sink deck 52 during installation as will be described later in detail.

Figure 6A:
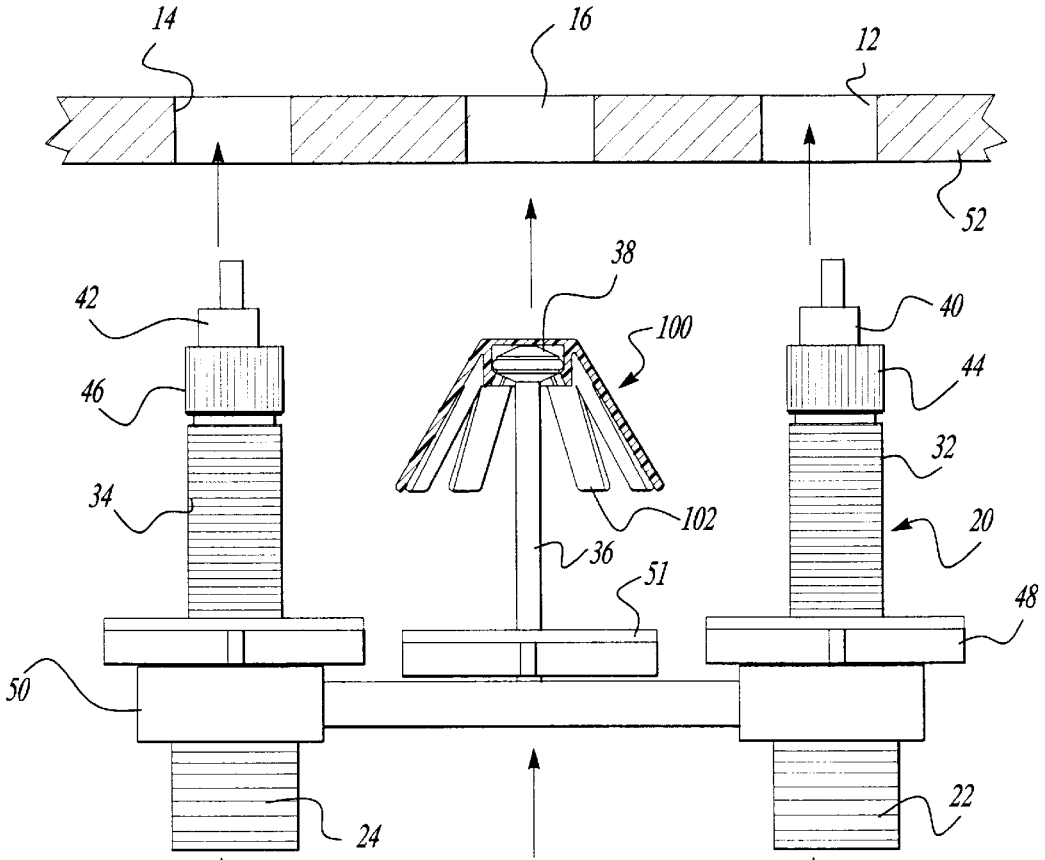
FIGS. 6*a*–6*d* are front elevational views illustrating the method of attaching a faucet body to a sink deck employing the installation aid of FIGS. 1–5.
Figure 6B:
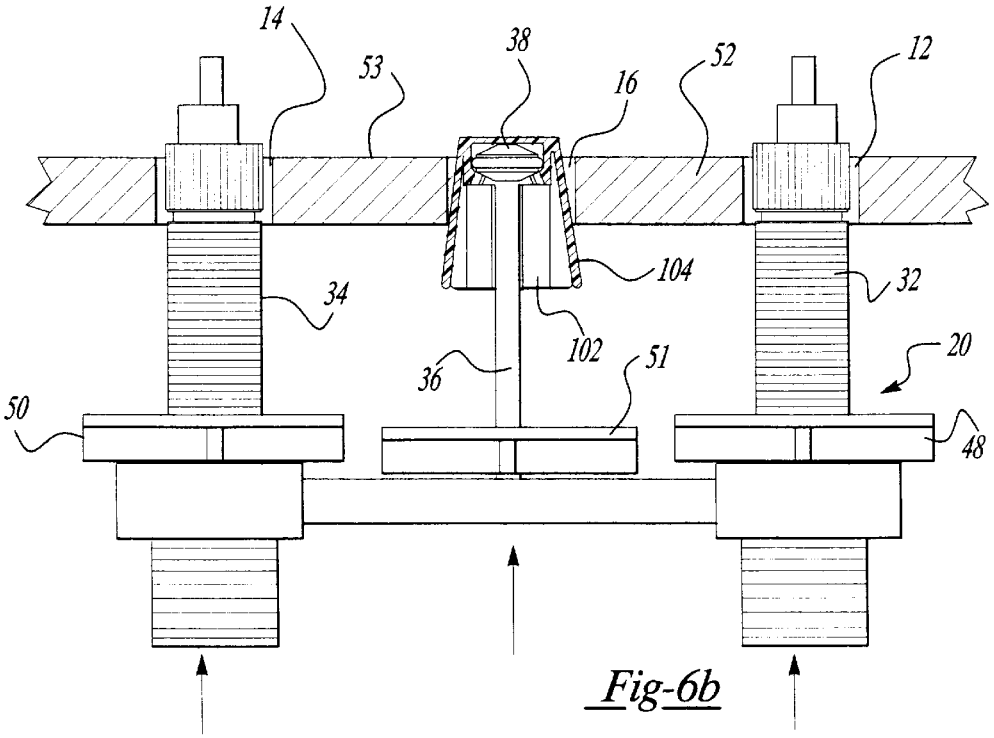
Figure 6C:
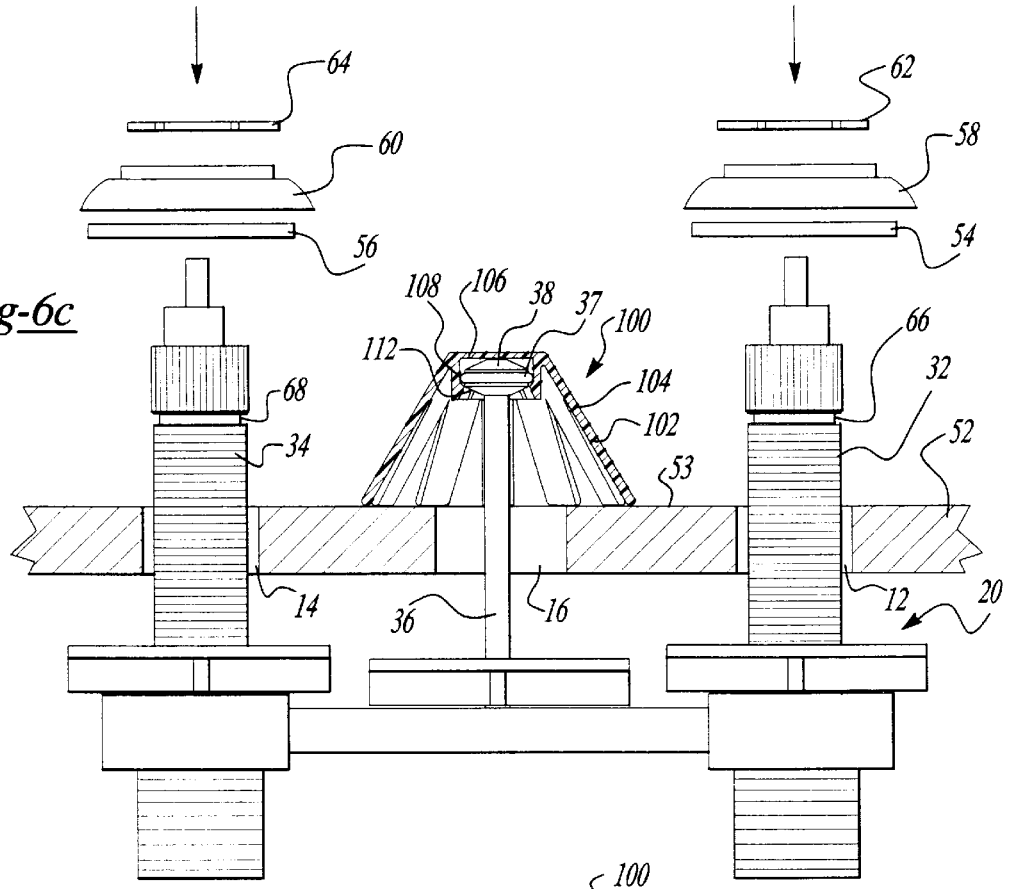
Figure 6D:
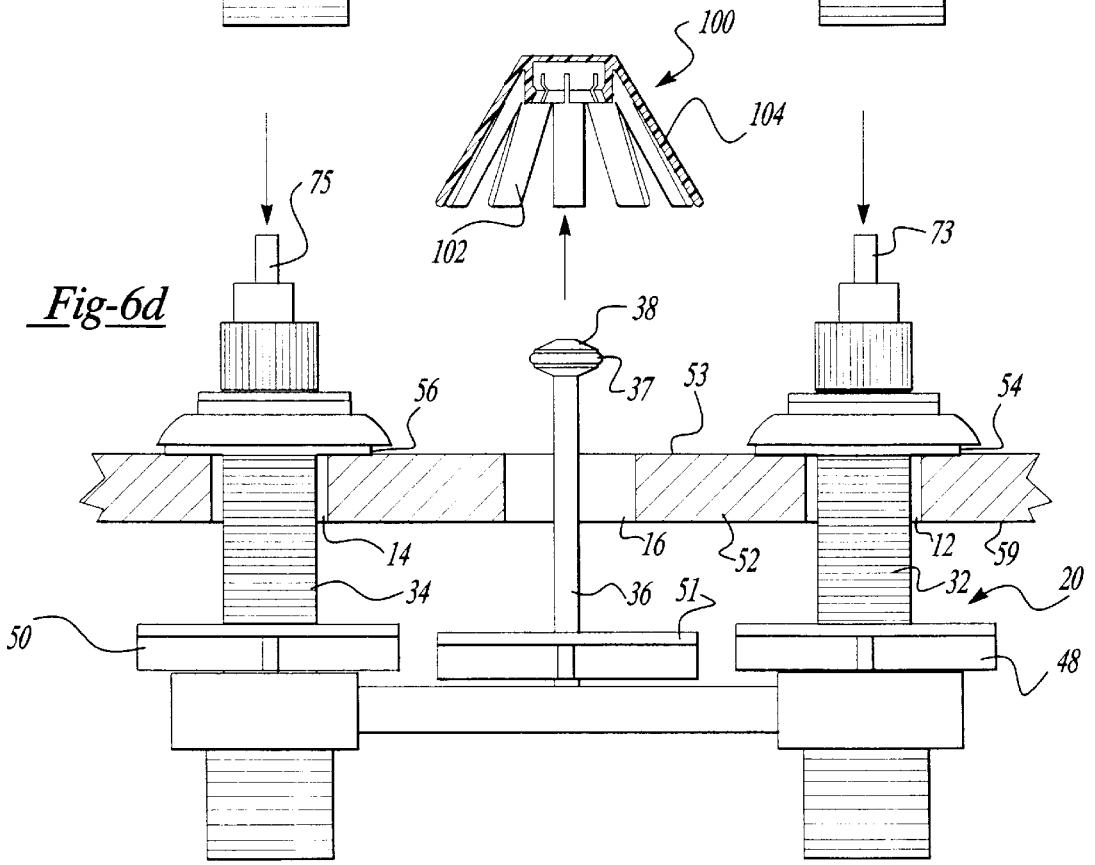

Referring to FIGS. 2–5, the installation aid 100 of the present invention preferably is molded polyproplyene and formed with a skirt 104 provided with a plurality of circumferentially spaced resilient legs 102 radiating outwardly and downwardly from its top portion 106 into a frusto-conical configuration. Under the top portion 106 and inside of the skirt 104 is formed a cap 108 with a plurality of circumferentially spaced retention fingers 110 extending downwardly and configured to snap fit tightly about the enlarged head 38 of the spout tube 36 (FIGS. 6*a*–6*c*). The bottom of the retention fingers 110 maybe chamfered. An undercut circular ledge 112 is formed on an inner wall 111 of cap 108 and adapted to wrap around the underside of enlarged head 38 to enable the installation aid 100 to temporarily support the entire weight of the faucet body 20 as it hangs from the installation aid 100 during installation before the faucet body 20 is fastened to the sink deck 52.

Installation of the faucet body 20 to the sink deck 52 will be described referring to FIGS. 6*a*–6*d*. The installation device 100 is snap fit onto the enlarged head 38 of the top of spout tube 36 of the faucet body 20 prior to installation. The upwardly extending valve tubes 32, 34 and spout tube 36 of the faucet body 20 with the installation aid 100 removably secured thereto is pushed up from below the sink deck 52 through corresponding valve body holes 12, 14 and spout tube hole 16 preformed in the sink deck 52. As seen in FIG. 6*b*, the legs 102 are squeezed together as the skirt 104 is forced upwardly through hole 16. When the bottom of the skirt 104 clears the top surface 53 of deck 52 the resilient legs 110 spring back allowing the installation device 100 to assume its original frusto-conical shape and stand on the top surface 53 of sink deck 52 radially outward from the hole 16 (FIG. 6*c*). At this step of the installation the faucet body assembly 20 is entirely supported from the top surface 53 of the sink deck 52 as the faucet body hangs downwardly from cap 108 formed on the underside of top 106. The installer is thus free to work with both hands above the sink deck 52 to instal gaskets 54, 56 and trim bases 58, 60 about the upper portions of valve tubes 32, 34 projecting above sink deck 52. Snap rings 62, 64 are then secured in grooves 66, 68 formed in valve tubes 32, 34. With the installation device 100 temporarily supporting the faucet body 20 and keeping it from falling down through holes 12, 14 and 16 the installer is freed from the need to hold the faucet body 20 with one hand under the sink deck 52 while reaching around with his other hand to attach the gaskets 54, 56, the trim bases 58, 60 and the snap rings 62, 64 onto the valve tubes 32, 34 from above the deck.

After the snap rings 62, 64 are fully seated into the grooves 66, 68, the installer grasps the skirt 104 of installation aid 100 and pulls it off the head 38 of spout tube 36 (FIG. 6*d*) allowing the faucet body 20 to drop slightly until the bottom of gaskets 54, 56 rest on the top surface 53 of sink deck 52. The installation aid 100 then may be discarded.

Figure 7:
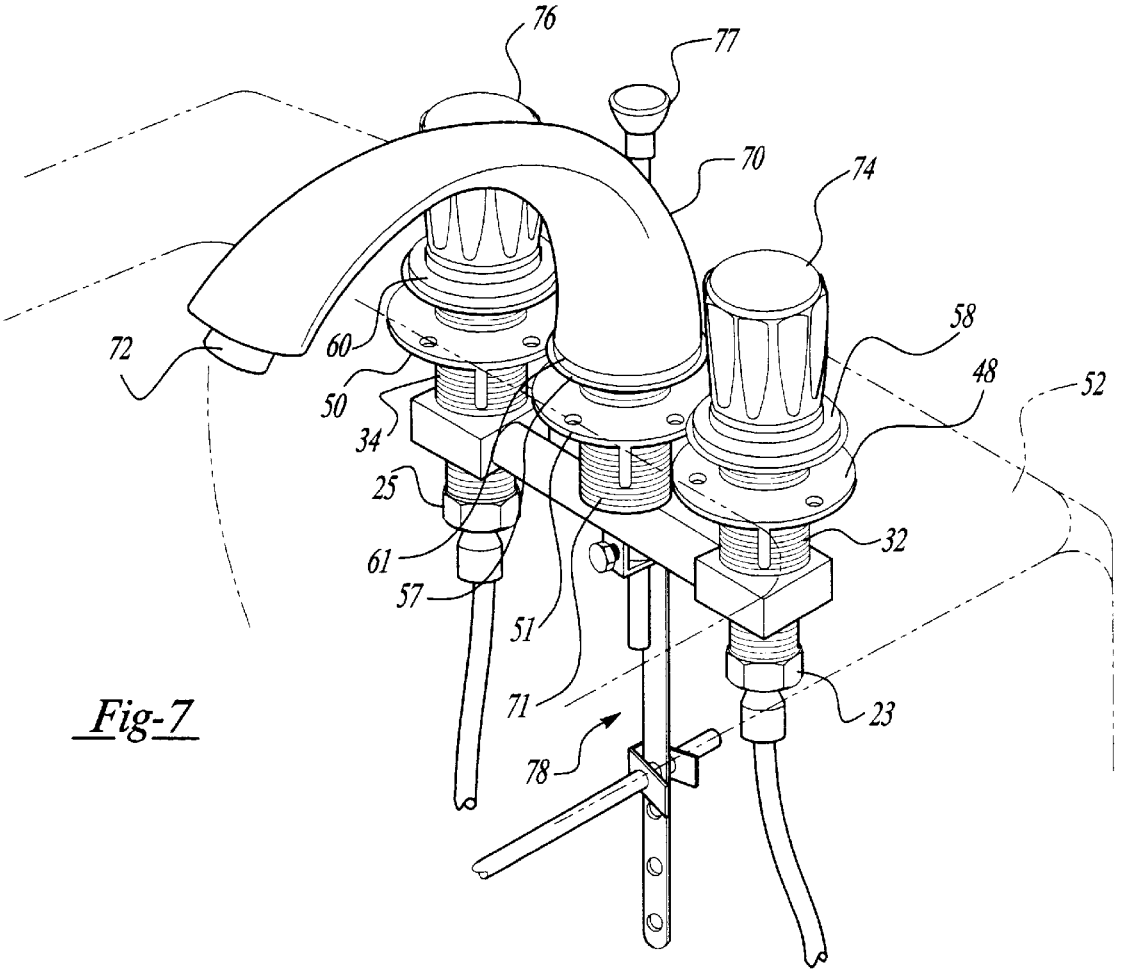
FIG. 7 is a perspective of the faucet assembly mounted to a sink deck after using the installation aid of FIGS. 1–5.

Referring to FIGS. 1 and 7, a spout gasket 57 and a spout base ring 61 are assembled about the upper portion of the spout tube 36 extending above the sink deck 52. The spout 70 with pre-attached aerator 72 is slid over the spout tube 36 with a lower threaded portion 71 passing through spout base ring 61, spout gasket 57, and through the spout hole 16 of sink deck 52.

The spout 70 and its associated base 61 and gasket 57 are assembled from above the sink deck 52 with the faucet body 20 now supported thereon by the valve tube attachments, i.e., snap ring 62, 64, trim rings 58, 60 and gaskets 54, 56 previously installed as described above.

The installer then manually tightens the lock nuts 48, 50 and 51, respectively, to the threaded portions of valve tubes 32, 34 and lower threaded portion 71 of spout 70 against the bottom surface 59 of sink deck 52 from below.

Finally, handles 74, 76 (FIG. 7) are attached to valve stems 73, 75 in a conventional manner along with a pop-up rod 77 attached to a standard pop-up assembly 78 completing the installation.

In view of the foregoing, it is readily apparent that the installation aid of the present invention provides a device for temporarily mounting a faucet body to a sink deck to allow an installer to assemble attachment hardware to valve tubes projecting upwardly through the sink deck while eliminating the need for the installer to support the faucet body with one hand from below the deck.

I claim:

1. A method of installing a faucet to a sink deck comprising the steps of attaching an installation aid to at least a portion of the faucet;

inserting said portion of said faucet and said installation aid mounted thereon upwardly from below said deck through at least one opening in said sink deck;

temporarily supporting said faucet on the top of said sink deck by said installation aid with said portion projecting upwardly above said sink deck prior to securing the faucet thereto, and securing said faucet to the sink deck from above the sink deck.

2. The method of claim 1 further comprising the step of removing the installation aid after said faucet is secured to said sink deck.

3. A method of installing to a sink deck a widespread faucet having a spout tube and at least one valve tube comprising the steps of attaching an installation aid to said spout tube;

inserting said at least one valve tube and said spout tube with said installation aid attached thereto upwardly from below said sink deck through openings in said sink deck for temporarily supporting said faucet on the top of said sink deck by said installation aid during installation with said valve tube projecting upwardly above said sink deck prior to attachment of a securing member; and attaching from above the sink deck a securing member to said upwardly projecting valve tube for securing said faucet to said sink from above the sink deck.

4. The method of claim 3 further comprising the step of removing said installation aid from said spout tube.

5. The method of claim 1 further comprising the steps of attaching a spout to said spout tube and attaching a handle to said valve tube.

* * * * *